US006348764B1

(12) United States Patent
Chen et al.

(10) Patent No.: US 6,348,764 B1
(45) Date of Patent: Feb. 19, 2002

(54) INDIRECT HOT CATHODE (IHC) ION SOURCE

(75) Inventors: Ming-Chung Chen; Yun-Chin Kuo, both of Hsin-Chu (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/641,263

(22) Filed: Aug. 17, 2000

(51) Int. Cl.[7] ..... H01J 7/24

(52) U.S. Cl. ..... 315/111.81; 250/423 R

(58) Field of Search ..... 315/111.81, 111.21, 315/111.71; 118/723 ME, 723 HC; 250/423 R, 427

(56) References Cited

U.S. PATENT DOCUMENTS 3,616,452 A * 10/1971 Bessot et al. ..... 204/298.06
4,448,802 A * 5/1984 Buhl et al. ..... 427/580
4,869,835 A * 9/1989 Ogawa et al. ..... 250/423 R
5,703,372 A * 12/1997 Horsky et al. ..... 250/423 R

* cited by examiner

*Primary Examiner*—Don Wong
*Assistant Examiner*—Ephrem Alemu
(74) *Attorney, Agent, or Firm*—Tung & Associates

(57) ABSTRACT

An indirect hot cathode ion source for use in an ion implanter is disclosed. The ion source can be constructed by a chamber formed of two endwalls, two sidewalls, a top and a bottom wall defining a cavity therein for producing plasma ions. An opening, or a slit through one sidewall of the chamber, is used for ejecting the plasma ions therethrough. Inside the ion source chamber, an anode, or an anti-cathode, is positioned in close proximity to a first endwall of the chamber, while a cathode is positioned in close proximity to a second endwall of the chamber opposing the first endwall. The cathode is constructed by a filament for passing an electrical current therethrough, and a filament shield of cylindrical shape surrounding the filament spaced apart from an inner periphery of an opening in the second endwall. The inner periphery of the opening in the second endwall is provided with a torroidal-shaped recess in and along an inner periphery of the opening adjacent to the cavity of the chamber such that deposition of materials on the inner periphery of the opening and electrical shorting or arcing with the filament shield can be avoided.

11 Claims, 2 Drawing Sheets

INDIRECT HOT CATHODE (IHC) ION SOURCE

FIELD OF THE INVENTION

The present invention generally relates to an ion source used in an ion implanter and more particularly, relates to an indirect hot cathode (IHC) ion source used in an ion implanter that does not have arcing problems caused by ion deposition at near the electrode.

BACKGROUND OF THE INVENTION

Ion implantation method has been used for placing impurity, or doping ions in a semiconductor material such as in a silicon substrate at precisely controlled depths and with accurate control of dopant ion concentration. One of the major benefits of the method is its capability to precisely place ions at preselected locations and at predetermined dosage. It is a very reproducible process that enables a high level of dopant uniformity. For instance, a typical variation of less than 1% can be obtained across a wafer.

An ion implanter operates by providing an ion source wherein collisions of electrons and neutral atoms result in a large number of various ions being produced. The ions required for doping are then selected out by an analyzing magnet and sent through an acceleration tube. The accelerated ions are then bombarded directly onto the portion of a silicon wafer where doping is required. The bombardment of the ion beam is usually conducted by scanning the beam or by rotating the wafer in order to achieve uniformity. A heavy layer of silicon dioxide or a heavy coating of a positive photoresist image is used as the implantation mask. The depth of the dopant ions implanted can be determined by the energy possessed by the dopant ions, which is normally adjustable by changing the acceleration chamber voltage. The dosage level of the implantation, i.e. the number of dopant ions that enters into the wafer, is determined by monitoring the number of ions passing through a detector. As a result, a precise control of the junction depth planted in a silicon substrate can be achieved by adjusting the implantation energy, while a precise control of the dopant concentration can be achieved by adjusting the dosage level.

A schematic of a conventional high energy ion implantation apparatus 10 is shown in FIG. 1. In the ion implanter 10, an ion source 20 is utilized in which collisions of electrons and neutral atoms result in a large quantity of various ions. The ions required for doping are then selected out by an analyzing magnet 12 and sent through an acceleration tube 14 that are then accelerated again by a high energy accelerator 16 equipped with an electron stripper and a magnet 18 to bombard a wafer 22 mounted on a mechanically scanned coned disc 24. The coned disc 24 has a capacity of 17 wafers for mounting on its surface and for scanning each wafer upon rotation of the disc 24. The high energy accelerator 16 operates at a high voltage, i.e. normally in a range between about 150 kV and about 750 kV. The coned disc 24 can be preprogrammed to tilt the wafers 22 mounted thereon at an implant angle between −100 to +10°. A usual implantation time required for each wafer is about 20 min.

A detailed cross-sectional view of the ion source 20 of FIG. 1 is shown in FIG. 2. The ion source 20 is constructed by a chamber 26 which includes a gas inlet 28 for feeding a reactive gas into the chamber cavity 30. A small quantity of a gas is passed through a vaporizer oven and then into the ion source chamber 30 which includes a cathode 40 and an anti-cathode 42. The cathode 40 further includes a heated filament 44 and a filament shield 46. The filament 44 is heated by a filament power supply 48 while the filament shield 46 is connected to a bias power supply 50. The ion source chamber 20 is further powered by an arch power supply 52 and a pre-acceleration power supply 54.

The ion source 20 can be operated in the following manner. First, the filament 44 is heated by passing electric current through it, derived from the power supply 48. The heating of the filament causes thermionic emission of electrons from the surface of the filament. An electric field, typically of a magnitude between 30 and 150 volts is applied between the filament and the chamber walls using the arc power supply 52. The field accelerates the electrons in the filament area to the chamber wall. A magnetic field is then introduced that is perpendicular to the electric field and causes the electrons to spiral outward, increasing the path length and chances for collisions with the gas molecules. The collisions break apart many of the molecules and ionize the resultant atoms and molecules by knocking outer shell electrons out of place. As charged particles, these atomic or molecular ions can now be controlled by magnetic and/or electric fields. Source magnets are employed to change the ion path from a straight path to a helicoid path. With one or more electrons missing, the particles carry a net positive charge. An extraction electrode, i.e. the anti-electrode, is placed in proximity to a slit and held at a negative potential attracts and accelerates the charged particles out of the chamber through the slit opening 32 provided in a sidewall 34 of the chamber 26. Ions 36 existing the chamber cavity 30 are passed through an acceleration tube 14 (FIG. 1) where they are accelerated and through the high energy accelerator 16 to the implantation energy as they move from high voltage to ground. The accelerated ions form a beam that is collimated by a set of apertures (not shown). The ion beam is then scattered over the surface of a wafer 22 mounted on the coned disc 24.

In the conventional ion source 20 shown in FIG. 2, after operation over a period of time, the processing of gases in the chamber cavity 30 results in the accumulation of materials 38 deposited from the gases. The material accumulation is especially severe at vicinities 56 that is close to the filament shield 46. Since the gap 58 provided in-between the filament shield 46 and the endwall 60 is usually very small, i.e. in the range of 1 mm to avoid the escape of plasma ions, the gap 58 is easily filled with the deposited materials and causing either arcing or electrical shorting between the chamber wall 60 and the filament shield 46. The arcing or electrical shorting around the filament shield 46 can cause serious machine malfunction by stopping the generation of plasma ions inside the ion source cavity.

It is therefore an object of the present invention to provide an indirect hot cathode ion source for an ion implanter that does not have the drawbacks or shortcomings of the conventional ion sources.

It is another object of the present invention to provide an indirect hot cathode ion source that does not have arcing or electrical shorting problems between a cathode and a chamber wall.

It is a further object of the present invention to provide an indirect hot cathode ion source that utilizes a cathode including a filament shield that does not have shorting or arcing problems with the chamber wall to which the shield is in close proximity.

It is another further object of the present invention to provide an indirect hot cathode ion source that is equipped with a cathode including a filament shield mounted in close proximity to an inner periphery of an opening in an endwall equipped with a torroidal-shaped recess adjacent to the filament shield for avoiding shorting or arcing.

It is still another object of the present invention to provide an indirect hot cathode ion source that is equipped with a filament shield spaced apart from an inner periphery of an opening in an endwall by a distance of at least 2 mm.

SUMMARY OF THE INVENTION

In accordance with the present invention, an indirect hot cathode ion source equipped with a filament shield spaced apart from an inner periphery of an opening in a chamber wall by a distance of at least 2 mm such that arcing or electrical shorting does not occur is provided.

In a preferred embodiment, an indirect hot cathode ion source is provided which includes a chamber formed by two endwalls, two sidewalls, a top and a bottom wall defining a cavity therein for producing plasma ions, an opening through one sidewall of the chamber for ejecting plasma ions therethrough, an anode situated inside the chamber positioned in close proximity to a first endwall of the chamber, and a cathode situated inside the chamber positioned in close proximity to a second endwall opposing the first endwall of the chamber.

The cathode further includes: a filament for passing an electrical current there through and a filament shield of cylindrical shape surrounding the filament spaced apart from an inner periphery of an opening in the second endwall, the inner periphery of the opening in the second endwall is provided with a torroidal-shaped recess in and along an inner periphery of the opening adjacent to the cavity of the chamber such that deposition of materials on the inner periphery of the opening and electrical shorting with the filament shield are avoided.

The indirect hot cathode ion source may further include a gas inlet through the chamber wall for feeding a gas into the chamber cavity. The torroidal-shaped recess in the inner periphery of the opening may have a width between about 1 mm and about 5 mm, and preferably between about 1 mm and about 3 mm. The filament housing of cylindrical shape may have a diameter between about 7 mm and about 20 mm, or a diameter preferably between about 8 mm and about 12 mm.

The plasma ions generated in the cavity may include $P^+$, $B^+$ and $As^+$. The chamber may be formed substantially of molybdenum. The inner periphery of the opening in the second endwall may be formed of graphite for high temperature endurance. A gap is formed between the filament shield and the inner periphery of the opening in the second endwall that is less than 2 mm. The first endwall, the two sidewalls and the top and bottom wall may be formed of molybdenum while the second endwall may be formed of graphite.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an indirect hot cathode ion source that is constructed of a chamber formed by two sidewalls, two endwalls, a top and a bottom wall defining a cavity therein for producing plasma ions. An opening is provided through one sidewall of the chamber, in the shape of a slit, for ejecting the plasma ions formed inside the ion source chamber. Inside the ion source chamber, an anode, or an anti-cathode, is positioned in close proximity to a first endwall of the chamber, while a cathode is positioned in close proximity to a second endwall opposing the first endwall of the chamber. The cathode is further constructed by a filament for passing an electrical current therethrough, and a filament shield of generally cylindrical shape surrounding the filament spaced apart from an inner periphery of an opening in the second endwall, the inner periphery of the opening in the second endwall may be provided with a torroidal-shaped recess in and along an inner periphery of the opening adjacent to the cavity of the chamber such that deposition of materials on the inner periphery of the opening, and the resulting flaking of materials causing electrical shorting or arcing with the filament shield can be avoided.

In the present invention indirect hot cathode ion source, a variety of gases can be flown into the chamber cavity for producing a variety of plasma ions. For instance, a variety of plasma ions of $P^+$, $B^+$ and $As^+$ can be generated. The material deposited on an inside wall of the ion source chamber may include materials formed by such plasma ions.

The present invention ion source chamber can be suitably fabricated of a material such as molybdenum, with the endwall to which the cathode is mounted fabricated of graphite for higher temperature endurance due to ion bombardment.

It is the unique discovery of the invention that by providing a torroidal-shaped recess in the endwall opening for mounting of the cathode, the flaking problem of the deposited material and the electrical shorting or arcing between the cathode and the endwall can be reduced or eliminated due to the fact that material deposition on the endwall in the area immediately surrounding the cathode is reduced.

Figure 1:
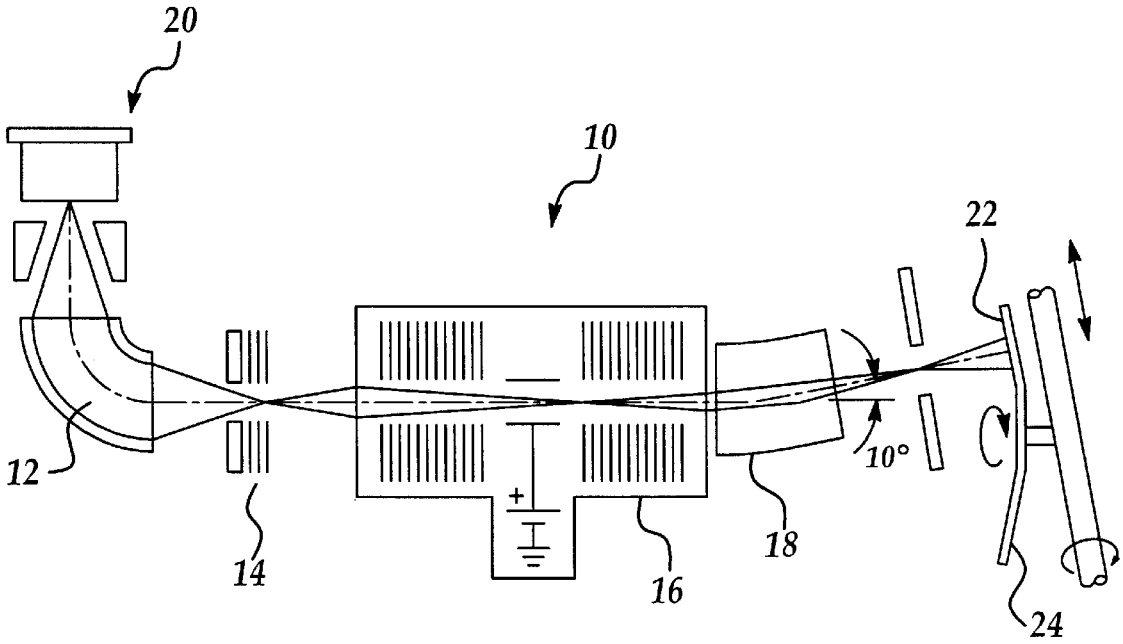
Figure 1 Prior Art
FIG. 1 is a graph illustrating a conventional ion implanter including an ion source.
Figure 2:
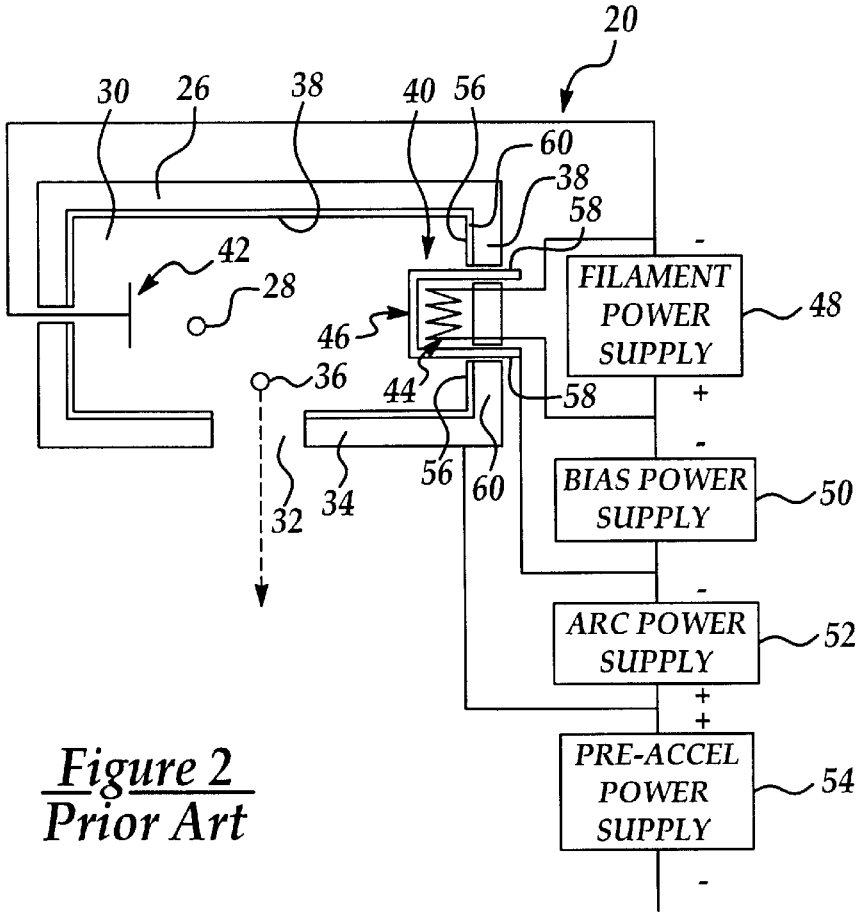
Figure 2 Prior Art
FIG. 2 is a detailed, cross-sectional view of the conventional ion source chamber of FIG. 1 including a cathode formed by a filament and a filament shield.
Figure 3:
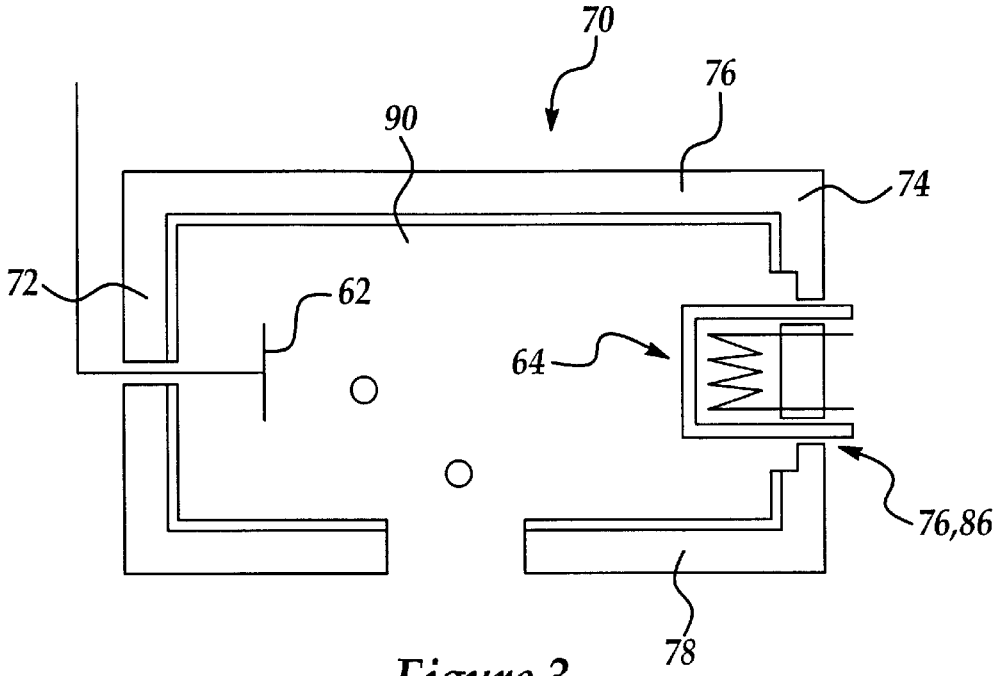
FIG. 3 is a detailed, cross-sectional view of the present invention ion source chamber including a modified endwall for mounting of the filament shield.

Referring now to FIG. 3, wherein a cross-sectional view of the present invention ion source chamber 70 is shown. The ion source chamber 70 is constructed by two endwalls 72,74, two sidewalls 76,78, a top wall and a bottom wall (not shown). It should be noted that the various power supplies, i.e. the filament power supply 48, the bias power supply 50, the arc power supply 52 and the pre-acceleration power supply 54 (shown in FIG. 2), are similarly connected in the present invention ion source chamber 70. These electrical circuits are not shown in FIG. 3 for simplicity reasons.

In the ion source chamber 70, an anode, or anti-cathode 62, is positioned in close proximity to the first endwall 72, while a cathode 64 is positioned in close proximity to the second endwall 74 in an opening 86. The cathode 64 is constructed of a filament 66 mounted on an insulating base 68 such as one made of ceramic material. The filament 66 is shielded in a filament shield 82 for protection.

Figure 3A:
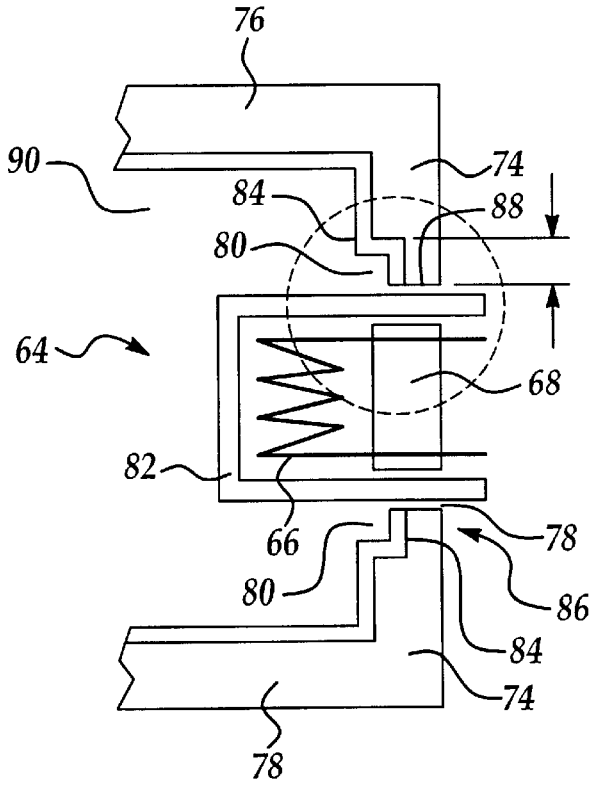
FIG. 3A is an enlarged, cross-sectional view of the present invention cathode assembly with a torroidal-shaped recess formed in the endwall to avoid shorting or arcing.

In the present invention novel ion source chamber 70, the opening 76 in the second endwall 74 is formed in such a way that a torroidal-shaped recess 80 is provided so that a "dark space" is formed which does not attract material deposition by the bombardment of plasma ions. Even when the recessed area 80 is coated with a deposited material, the recess provides more space to accommodate the coated material, thus avoiding electrical short or arcing problems from occurring between the deposited material layer 84 and the filament shield 82. It has been found that a suitable length "l" is between about 1 mm and about 5 mm, and preferably between about 2 mm and about 3 mm (as shown in FIG. 3A). The word "about" used in this writing indicates a range of values that is ±10% from the average value given.

An enlarged view of the cathode 64 and the opening 76 in the second endwall 74 are shown in FIG. 3A. It should be noted that a suitable dimension of the filament housing is between about 7 mm and about 20 mm in diameter, or preferably between about 8 mm and about 12 mm in diameter. A most suitable size may be 10 mm in diameter. It was found that a suitable gap 78 formed between the filament shield 82 and the inner periphery 88 of the opening 86 in the second endwall 74 may be less than 2 mm, and preferably at about 1 mm in order to prevent the escape of plasma ions outside the chamber cavity 90.

The present invention novel positioning of the cathode 64 in the opening 86 with the torroidal-shaped recess 80 in the second endwall 74 enables an ion implantation process to be conducted by producing plasma ions in the chamber cavity 90 without material deposition problems in the vicinity between the filament shield 82 and the inner periphery 88 of the opening 86. By utilizing the present invention novel structure, it was found that more than 200 hours of ion implantation process can be carried out without the necessity of a preventive maintenance procedure. This is a significant improvement over the conventional structure which requires a preventive maintenance procedure after 125 hours usage of the ion source chamber. At least 50% more of machine uptime is gained by utilizing the present invention novel invention.

The present invention novel indirect hot cathode ion source chamber has therefore been amply described in the above description and in the appended drawings of FIGS. 3 and 3A.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

What is claimed is:

1. An indirect hot cathode ion source comprising:

a chamber formed by two endwalls, two sidewalls, a top and a bottom wall defining a cavity therein;

an opening through one sidewall of said chamber for ejecting said plasma ions therethrough;

an anode situated inside said chamber positioned in close proximity to a first endwall of said chamber;

a cathode situated inside said chamber positioned in close proximity to a second endwall opposing said first endwall of said chamber;

said cathode comprises:

a filament for passing an electrical current therethrough; and a filament shield of cylindrical shape surrounding said filament spaced apart from an inner periphery of an opening in said second endwall, said inner periphery of said opening in said second endwall being provided with a toroidal-shaped recess in and along an inner periphery of said opening adjacent to said cavity of the chamber such that deposition of materials on said inner periphery of said opening and electrical shorting with said filament shield are avoided.

2. An indirect hot cathode ion source according to claim 1 further comprising a gas inlet through said chamber for feeding a gas therein.

3. An indirect hot cathode ion source according to claim 1, wherein said toroidal-shaped recess in said inner periphery of said opening has a width between about 1 mm and about 5 mm.

4. An indirect hot cathode ion source according to claim 1, wherein said toroidal-shaped recess in said inner periphery of said opening has a width between about 1 mm and about 5 mm, and preferably has a width between about 2 mm and about 3 mm.

5. An indirect hot cathode ion source according to claim 1, wherein said filament housing of cylindrical shape has a diameter between about 7 mm and about 20 mm.

6. An indirect hot cathode ion source according to claim 1, wherein said filament housing of cylindrical shape has a diameter between about 7 mm and about 20 mm, and preferably between about 8 mm and about 12 mm.

7. An indirect hot cathode ion source according to claim 1, wherein said plasma ions generated in said cavity comprises $P^+$, $B^+$ and $As^+$.

8. An indirect hot cathode ion source according to claim 1, wherein said chamber being formed substantially of molybdenum.

9. An indirect hot cathode ion source according to claim 1, wherein said chamber being formed substantially of molybdenum, while said inner periphery of said opening in the second endwall being formed of graphite or tungsten.

10. An indirect hot cathode ion source according to claim 1, wherein a gap formed between said filament shield and said inner periphery of said opening in the second endwall being less than 2 mm.

11. An indirect hot cathode ion source according to claim 1, wherein said first endwall, said two sidewalls and said top and bottom wall comprise molybdenum, while said second endwall comprises graphite or tungsten.

* * * * *